US008161897B2

(12) United States Patent
Fujihara

(10) Patent No.: US 8,161,897 B2
(45) Date of Patent: Apr. 24, 2012

(54) KNEE LEVER FOR SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 397 days.

(21) Appl. No.: 12/458,022

(22) Filed: Jun. 29, 2009

(65) Prior Publication Data

US 2010/0000453 A1 Jan. 7, 2010

(30) Foreign Application Priority Data

Jul. 1, 2008 (JP) ..... 2008-172298

(51) Int. Cl.
*D05B 69/00* (2006.01)

(52) U.S. Cl. ..... 112/217.3

(58) Field of Classification Search ..... 112/237, 112/235, 238, 239, 217.1, 217.3, 217.4, 150, 112/151, 284
See application file for complete search history.

(56) References Cited

U.S. PATENT DOCUMENTS

| | | | | |
|---|---|---|---|---|
| 3,353,511 | A | 11/1967 | Marino | |
| 3,570,428 | A * | 3/1971 | Sternberg | 112/270 |
| 3,777,686 | A * | 12/1973 | Hage | 112/237 |
| 3,818,849 | A * | 6/1974 | Maddox, Jr. | 112/275 |
| 4,333,407 | A * | 6/1982 | Lerch | 112/237 |
| 4,409,914 | A * | 10/1983 | Sansone | 112/237 |
| 4,773,342 | A * | 9/1988 | Fietta | 112/129 |
| 5,544,600 | A * | 8/1996 | Hunt | 112/217.3 |
| 6,520,101 | B2 * | 2/2003 | Sano et al. | 112/237 |

FOREIGN PATENT DOCUMENTS

| | | |
|---|---|---|
| GB | 471594 A | 9/1937 |
| JP | Y-40-11882 | 4/1965 |
| JP | Y-52-709 | 1/1977 |
| JP | U-53-34453 | 3/1978 |
| JP | U-59-188074 | 12/1984 |
| JP | U-60-70280 | 5/1985 |
| JP | Y2-62-15029 | 4/1987 |
| JP | A-04-132586 | 5/1992 |
| JP | U-07-44445 | 11/1995 |
| JP | A-11-207066 | 8/1999 |
| JP | A-2000-93677 | 4/2000 |
| JP | A-2003-326036 | 11/2003 |

OTHER PUBLICATIONS

European Search Report issued in European Application No. 09164286.8-2314 on Nov. 2, 2009.
Office Action issued in Japanese Patent Application No. 2008-172298, dated Jul. 27, 2010 (with English translation).
Office Action in Japanese Patent Application No. 2008-172298, dated Oct. 19, 2010 (with English translation).

* cited by examiner

*Primary Examiner* — Tejash Patel
(74) *Attorney, Agent, or Firm* — Oliff & Berridge, PLC

(57) ABSTRACT

A knee lever a lever including a lever detachably attached to an attachment provided on a bed of a sewing machine; a knee rest mounted on the lever and operated by knee contact, with the lever being attached to the attachment; an adjustment mechanism allowing adjustment in position of knee contact of the knee rest; wherein the adjustment mechanism includes an engagement portion provided at the lever, and an engagement subject provided at the knee rest and being disengagably engaged with the engagement portion to switch a mounting position of the knee rest relative to the lever.

4 Claims, 13 Drawing Sheets

KNEE LEVER FOR SEWING MACHINE

CROSS-REFERENCE TO RELATED APPLICATIONS

This application is based upon and claims the benefit of priority from the prior Japanese Patent Application 2008-172298, filed on Jul. 1, 2008, the entire contents of which are incorporated herein by reference.

FIELD

The present disclosure relates to a knee lever that elevates a presser foot of a sewing machine through operation controlled by user's knees and a sewing machine provided with such knee lever.

BACKGROUND

Sewing machines have been conventionally provided with a presser foot for pressing a workpiece cloth against a sewing machine bed. The presser foot is typically attached to a lower end of a presser bar which is vertically movably supported by a head provided at the extremity of a sewing machine arm. Under such configuration, a presser foot lifting unit provided with a presser foot lifting lever for lifting the presser foot is generally provided within the head. The presser foot lifting unit is configured to vertically move the presser bar and the presser foot by manual rotation of the presser foot lifting lever by the user.

Some sewing machines are provided with a knee lever instead of a manually operated presser foot lifting lever to allow the user to vertically move the presser foot by operation of the knee lever with his/her knees. Such types of sewing machines are provided, at the sewing machine bed (or sewing machine table), components such as a knee lever attachment (hereinafter referred to as an attachment), an operative shaft rotating integrally with the attachment and a link mechanism providing linkage between the operative shaft and the presser foot. Under such configuration, when the knee lever is laterally moved by user operation, the attachment and the operative shaft are rotated to vertically move the presser foot through the link mechanism.

One example of such sewing machine is disclosed, for example, in JP S62-15029 Y hereinafter referred to as patent publication 1 in which a guide mechanism is provided between the attachment and the operative shaft. The guide mechanism is provided with a guide member including a guide cam and being secured on the sewing machine table and a swing arm provided on the operative shaft. The guide mechanism is configured to guide the attachment and consequently the knee lever through engagement of a pair of pins disposed at a lower portion of the attachment with the guide cam and the swing arm. The knee lever, on the other hand, is provided with a rod secured on the attachment and a knee rest provided on the rod. The rod comprises a vertical section and a horizontal section and is generally curved in an "L-shape". The horizontal section is secured to the attachment by a screw serving as a fastening element. In the disclosed sewing machine, when the user laterally moves his/her knees to laterally operate the knee rest, the guide mechanism guides the knee rest so that the path of its movement follows the user knee movement. Such guidance feature allows smooth and stress free knee operation of the knee lever.

Another example is disclosed in JP H11-207066 A, hereinafter referred to as patent publication 2. Patent publication 2 discloses a presser lifting unit allowing detachable attachment of knee lever to provide the user with an option to control the vertical movement of the presser foot with the knee lever.

The problem encountered in the knee lever operation disclosed in patent publication 1 was the variability in the requirement in the positioning of the knee rest depending upon the physiques of the user. For instance, some users may feel that the knee rest is too far away whereas some may feel that it is too close for stress free operation. In such case, the user is forced to go through a troublesome task of knee lever adjustment involving unfastening of the screw with special tools such as a wrench, then, laterally moving the horizontal section of the rod to reposition the knee lever in its entirety, and fastening the screw again with the tool. The guide mechanism mentioned earlier for providing guidance during the knee lever operation is disposed on the sewing machine by screw fastening as was the case for the attachment. Such configuration also complicated the structure of the sewing machine.

The knee lever disclosed in patent publication 2 does not allow adjustment in its positioning relative to the sewing machine, and thus, provided poor operability if its positioning did not suit the physiques of the user.

SUMMARY

One object of the present disclosure is to provide a knee lever for use with a sewing machine that can be adjusted in positioning to meet the requirements of user preference without requiring any additional features on the sewing machine. It is another object of the present disclosure to provide a sewing machine provided with such knee lever.

In one aspect of the present disclosure, a knee lever is provided for use in a sewing machine including a bed having an attachment, a head, and a presser bar being supported by the head and having a presser foot at a lower end thereof. The knee lever is detachably attached to the attachment to be operated by knee contact for lifting the presser foot. The knee lever includes a lever that is detachably attached to the attachment; a knee rest that is mounted on the lever and that is operated by knee contact, with the lever being attached to the attachment; an adjustment mechanism that allows adjustment in position of knee contact of the knee rest; wherein the adjustment mechanism includes an engagement portion that is provided at the lever, and an engagement subject that is provided at the knee rest and being disengagably engaged with the engagement portion to switch a mounting position of the knee rest relative to the lever.

According to the above described configuration, the adjustment mechanism provides improved operability by allowing the user to adjust the position of the knee lever to suit the user's physique or preferences. Further, the configuration of the adjustment mechanism is simplified by allowing the mounting position of the knee rest to be readily changed by merely establishing/canceling the engagement of the engagement portion and the engagement subject of the adjustment mechanism. Moreover, the adjustment mechanism has been provided at the knee lever and thus, the sewing machine may maintain its conventional configuration without having to be provided with the adjustment mechanism.

In another aspect of the present disclosure, a knee lever is provided for use in a sewing machine including a bed having an attachment, a head, and a presser bar being supported by the head and having a presser foot at a lower end thereof. The knee lever is detachably attached to the attachment to be operated by knee contact for lifting the presser foot. The knee lever includes a lever that is detachably attached to the attachment; a knee rest that is mounted on the lever and that is operated by knee contact, with the lever being attached to the attachment; an adjustment mechanism that allows adjustment in position of knee contact of the knee rest; wherein the adjustment mechanism includes a link mechanism that links the lever and the knee rest and that allows adjustment in a distance between the lever and the knee rest, and a retention mechanism that retains the distance between the lever and the knee rest at a predetermined distance.

According to the above described configuration, the adjustment mechanism provides improved operability by allowing the user to adjust the position of the knee lever to suit the user's physique or preferences. Further, the adjustment mechanism has been provided at the knee lever and thus, the sewing machine may maintain its conventional configuration without having to be provided with the adjustment mechanism. Yet further, the knee rest can be moved to establish knee contact at the desired position with improved accuracy by way of the link mechanism provided at the adjustment mechanism in a relatively simple configuration. Moreover, the retention mechanism prevents once established mounting position of the knee rest from being precariously switched to other mounting positions.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One exemplary embodiment applying the present disclosure to a household sewing machine will be described hereinafter with reference to FIGS. 1 to 12. The following description will be given with an assumption that the direction in which the operator (user) positions himself/herself relative to the sewing machine is the front side.

Figure 1:
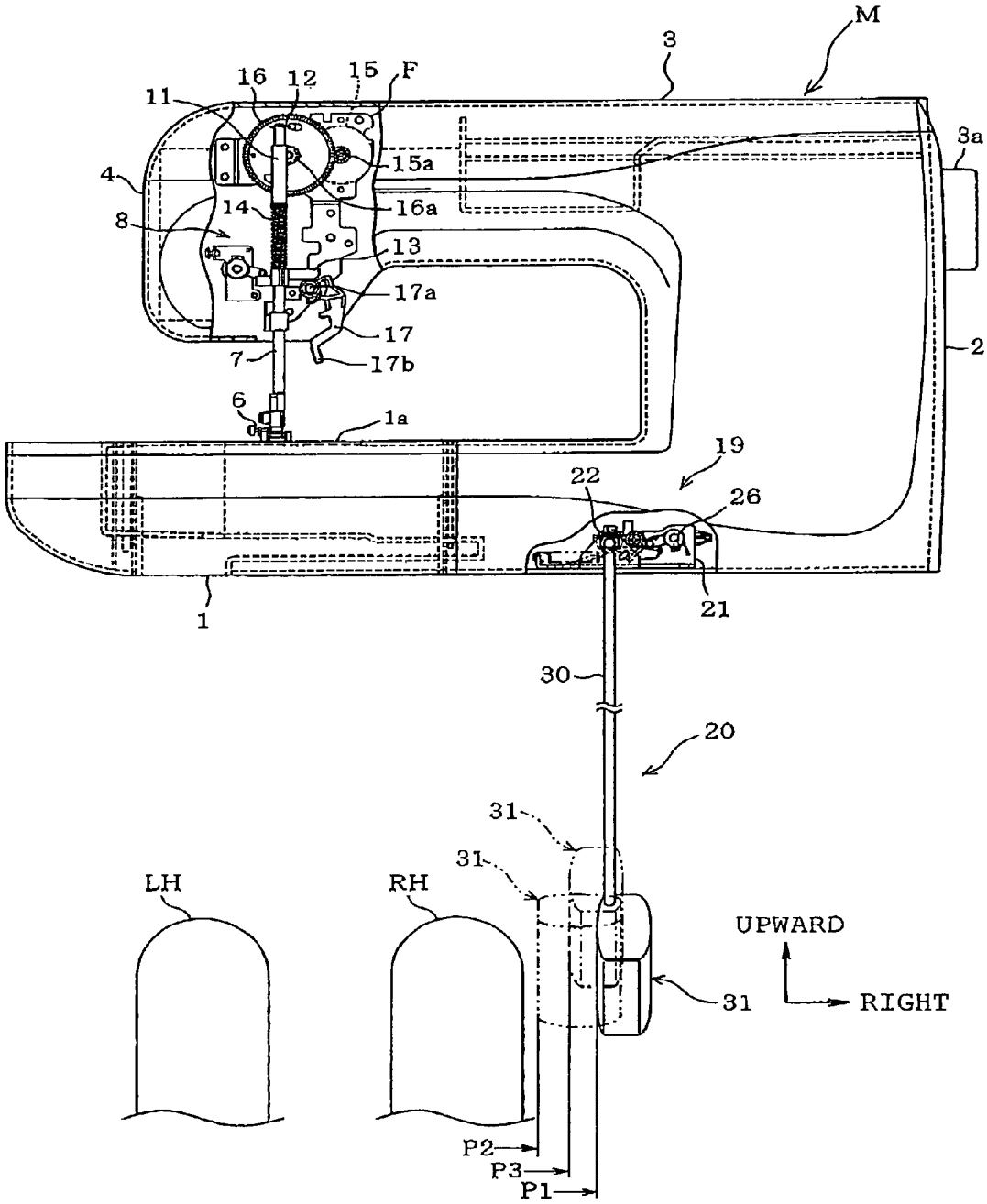
FIG. 1 is a front view of a sewing machine and a knee lever in a standby position according to one exemplary embodiment of the present disclosure.

Referring to FIG. 1, a sewing machine M is provided with a bed 1, an upwardly extending pillar 2 standing on the right end of bed 1, and an arm 3 extending leftward over bed 1 from the upper end of pillar 2. The extreme left end of arm 3 constitutes an integral head 4. Arm 3 contains a laterally oriented main shaft not shown and a sewing machine motor 5 shown in FIG. 12 that rotates the sewing machine main shaft. On the right side of arm 3, a hand pulley 3*a* is provided to allow manual rotation of the main shaft.

Head 4 has a needle bar having a sewing needle (neither of which are shown) attached on its lower end and a presser bar 7 having a presser foot 6 attached to its lower end. Presser bar 7 situated behind the needle bar is supported vertically movably by a sewing machine frame F and is vertically driven by a presser bar drive mechanism 8. Though not shown, arm 3 further contains components such as a needle bar drive mechanism that vertically drives the needle bar based on the rotation of the sewing machine main shaft, a needle bar swing mechanism that laterally (left and right) swings the needle bar in a direction orthogonal to the cloth feed direction, and a thread take-up drive mechanism that vertically moves a thread take-up in synchronism with the vertical movement of the needle bar.

Figure 12:
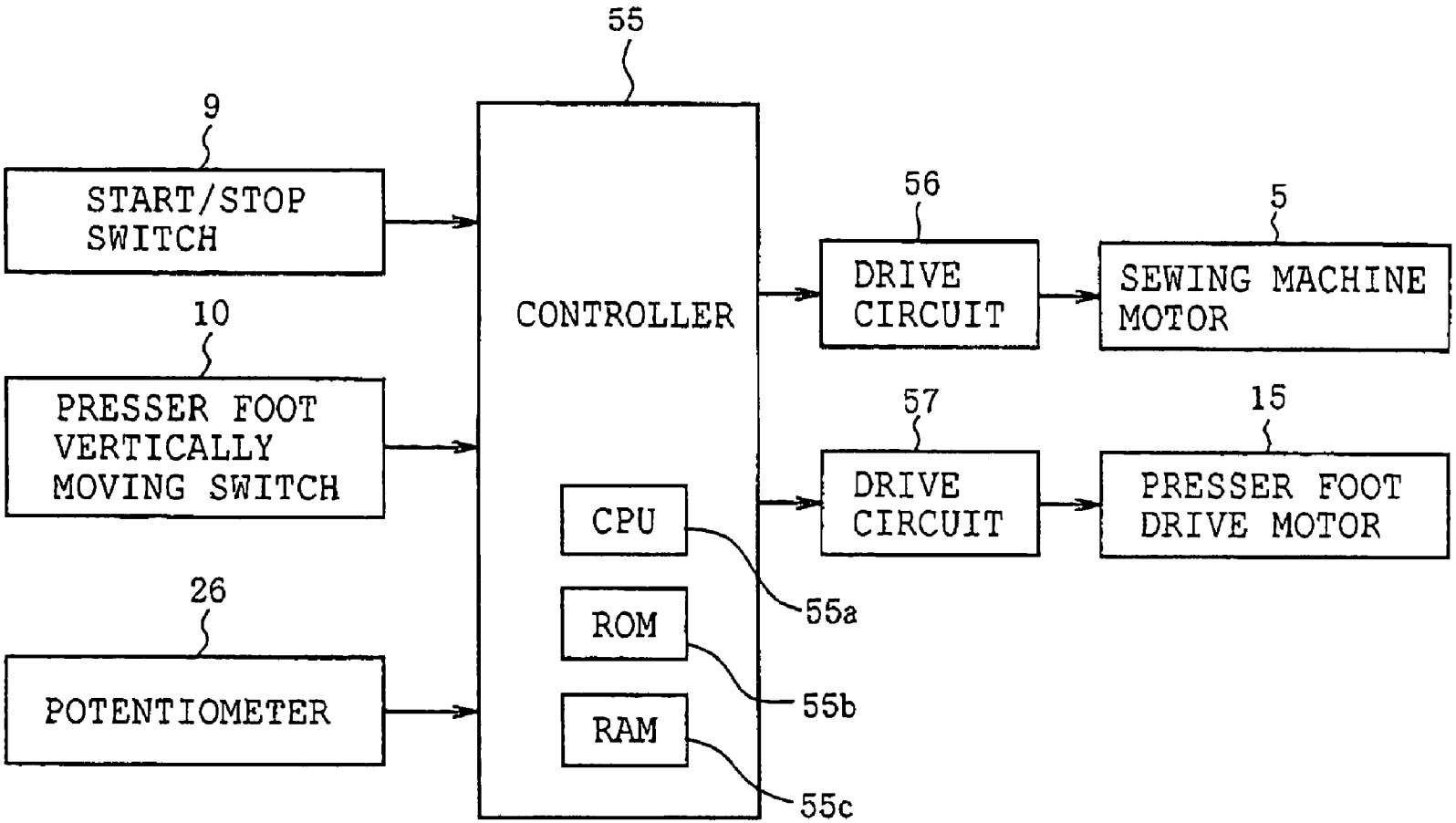
FIG. 12 is a block diagram of an electrical configuration.

Provided on the upper surface of bed 1 is a needle plate 1*a*. Though not shown, within bed 1, in other words, below needle plate 1*a*, components such as a cloth feed mechanism that vertically and longitudinally moves a feed dog, horizontal shuttle mechanism containing a bobbin thread bobbin that forms stitches on a workpiece cloth W in cooperation with sewing needle, and a thread cut mechanism that cuts a needle thread and a bobbin thread are provided. On the front face of pillar 2, a liquid crystal display not shown is provided, whereas on the front face of arm 3, various switches such as a start/stop switch 9 shown in FIG. 12 and a presser foot vertically moving switch 10 also shown in FIG. 12 are provided.

Next a description will be given on presser bar drive mechanism B for vertically moving presser bar 7 having a presser foot 6 attached to it. On the upper end portion of presser bar 7, a rack forming element 11 is fitted vertically movably over it and a stop ring 47 is secured at the upper end of presser bar 7. Presser bar 7 is further provided with a presser bar clamp 13 secured at its vertical mid portion and a spring 14 is fitted over it at a portion between rack forming element 11 and presser bar clamp 13.

Figure 2:
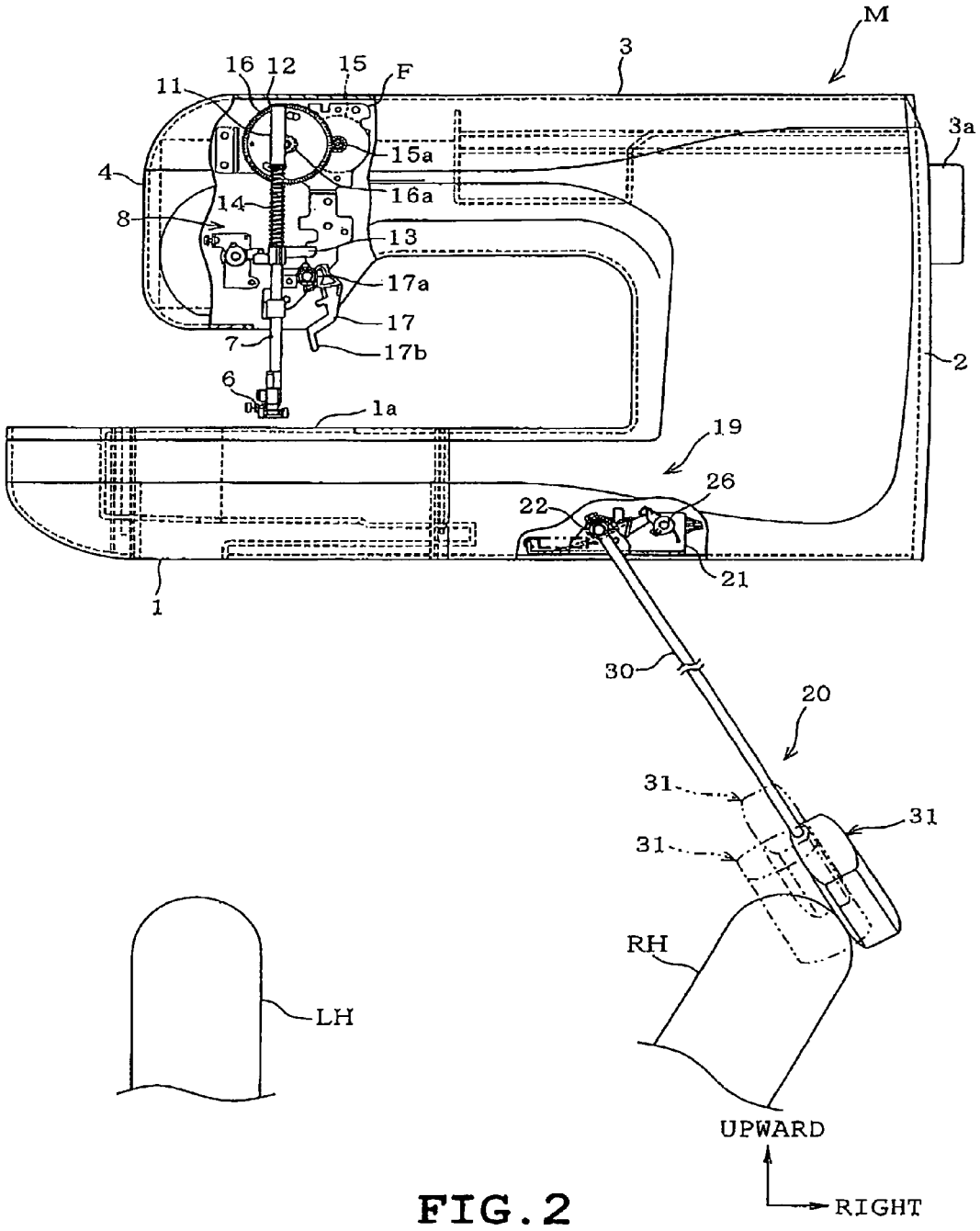
FIG. 2 corresponds to FIG. 1 with the knee lever being moved to the operative position.

On the other hand, sewing machine frame F is provided with presser foot drive motor 15 having a drive gear 15*a* attached on its output shaft and an intermediate gear 16 in mesh with drive gear 15*a*. The intermediate gear 16 is provided integrally with a small-diameter pinion 16*a* in mesh with a rack not shown formed on rack forming element 11. Thus, when presser foot drive motor 15 is driven, the drive force is transmitted to rack forming element 11 via intermediate gear 16 to vertically move the presser bar 7. More specifically, when rack forming element 11 is lowered, presser bar clamp 13 is pressed via spring 14 to lower presser bar 7 and consequently presser foot 6 to a press position to press a workpiece cloth not shown provided on a needle plate 1*a*. In contrast, when rack forming element 11 is elevated, the upper end of rack forming element 11 is placed in abutment with stop ring 12 to elevate presser bar 7 such that presser foot 6 is raised to an elevated position spaced by a predetermined spacing from the workpiece cloth as can be seen in FIG. 2.

The above described components such as rack forming element 11, stop ring 12, presser bar clamp 13, spring 14, drive gear 15*a*, presser foot drive motor 15, intermediate gear 16, and pinion 16*a* constitute presser bar drive mechanism 8. Sewing machine M according to the present exemplary embodiment is provided with a presser foot lifting lever 17 for manually operating presser foot 6 independent of presser bar drive mechanism 8. One end of a presser foot lifting lever 17 is pivoted on sewing machine frame F by a pin 17*a*. Presser foot lifting lever 17, when manually operated at its free end, vertically moves presser foot 6 through presser bar clamp 13.

An attachment 19 is provided on bed 1 to allow detachable attachment of knee lever 20 for elevating presser foot 6 through operation by user's knees. The structures in the proximity of knee lever 20 and attachment 19 will be described with reference to FIGS. 3 to 10B. Attachment 19 employed in the present exemplary embodiment is similar to those provided in conventional sewing machines.

Figure 3:
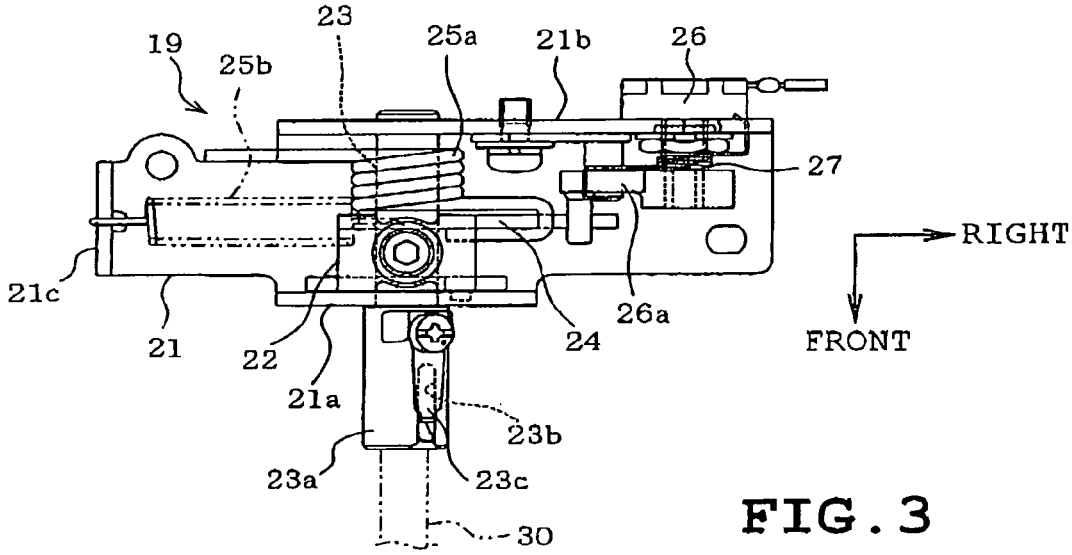
FIG. 3 is an enlarged plan view of an attachment.
Figure 4A:
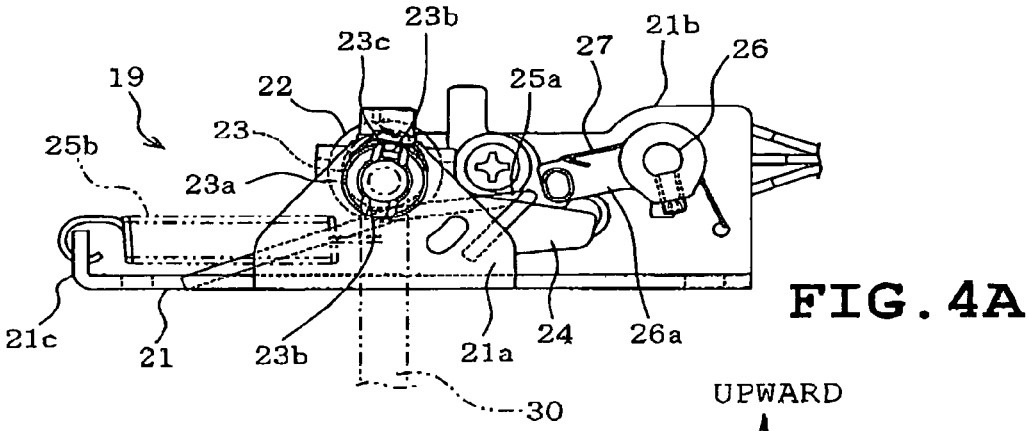
FIG. 4A is an enlarged front view of the attachment with the knee lever in the standby position.
Figure 4B:
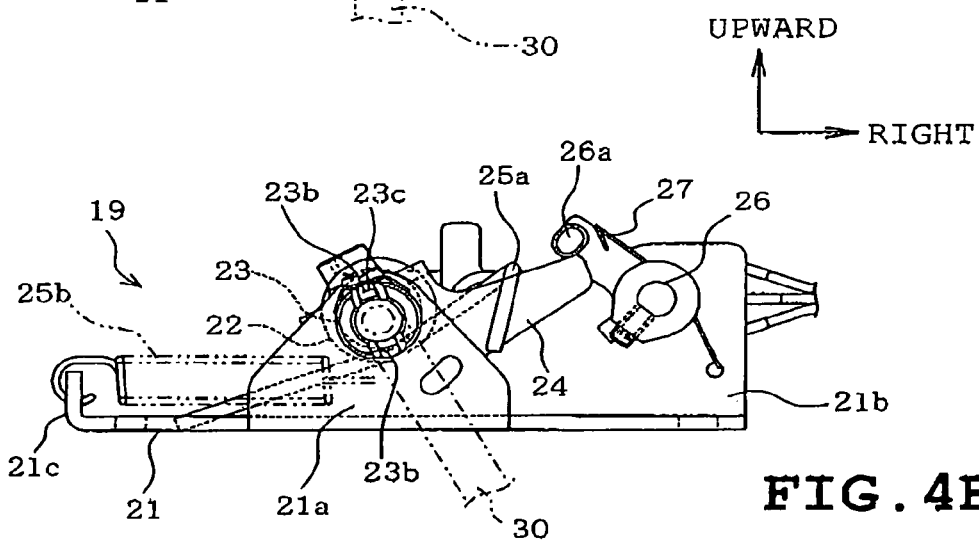
FIG. 4B corresponds to FIG. 4A and is a front view the knee lever in the operative position.

Attachment 19 is positioned slightly to the right from the lower mid portion of bed 1 and is provided with a laterally elongate stationary frame 21 shown in FIGS. 3 to 4B and a rotary element 22 provided rotatably on stationary frame 21. To elaborate, rotary element 22 is integrally provided with a shaft 23 that penetrates front and rear walls 21*a* and 21*b* of stationary frame 21, and an arm 24 projecting rightward relative to shaft 23. On the front end of shaft 23, a cylindrical engagement retainer 23*a* is provided that allows detachable attachment of knee lever 20. Engagement retainer 23*a* has a notch 23*b* running in the axial direction at its front portion and an elastic tab 23*c* opposing notch 23*b*. When engagement retainer 23*a* receives engagement subject 32 of a later described lever 30 shown in FIG. 6, engagement subject 32 is radially urged by elastic tab 23*c*, to secure the fitting engagement and allow rotary element 22 to rotate integrally with knee lever 20. Rotary element 22 is appropriately limited in amount of rotation by a regulator not shown so as to rotate between horizontal position show in FIG. 4A in which arm 24 is substantially horizontal and an inclined position shown in FIG. 4B in which arm 24 is inclined by a predetermined angle. The rotation of knee lever 20, being limited by the regulator through rotary element 22, ranges between a standby position shown in FIG. 1 in which knee lever 20 in its entirety is oriented substantially vertically in front view, and an operative position shown in FIG. 2 in which knee lever 20 in its entirety us inclined by a predetermined angle.

At the rear portion of shaft 23 of rotary element 22, a torsion coil spring 25*a* is wound, whereas a helical extension spring 25*b* is disposed between the base end of arm 24 and left wall 21*c* of rotary element 22. Torsion coil spring 25*a* and helical extension spring 25*b* bias rotary element 22 toward the horizontal position, in other words, clockwise as viewed in FIG. 4B.

On a rear wall 21*b* of stationary frame 21, a displacement sensor such as a potentiometer 26 is provided for sensing the position of knee lever 20. On a rotary shaft of potentiometer 26, an arm 26*a* and a helical coil spring 27 are provided that biases arm 26*a* toward the upper surface of arm 24*a*. Potentiometer 26, thus, switches its resistance by rotation of arm 26*a* through rotary element 22 in response to the rotation of knee lever 20.

Figures 5A, 5B:
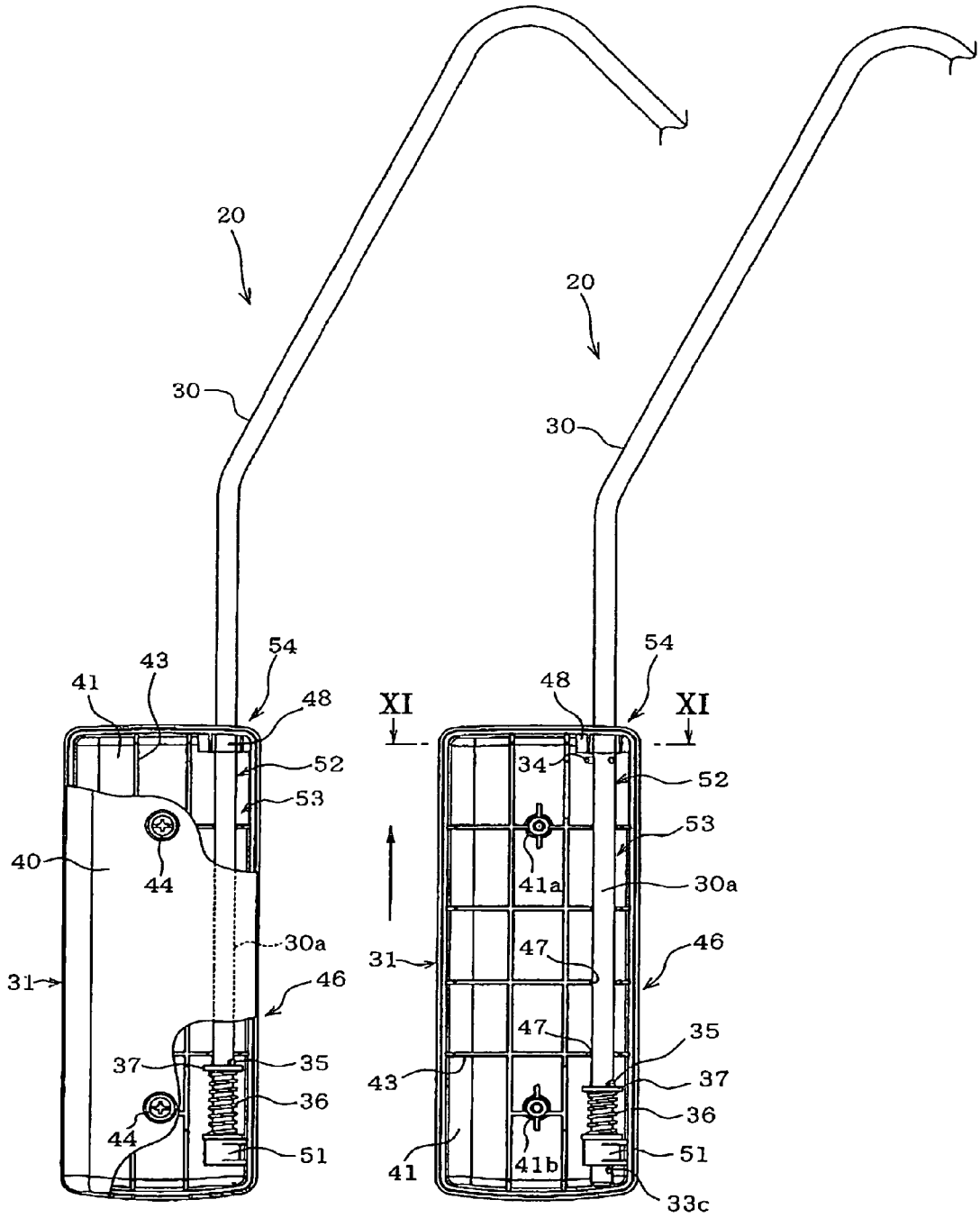
FIG. 5A is a side view of a knee rest being locked unmovably relative to a lever.
FIG. 5B is a side view of a knee rest being allowed to rotate relative to the lever.
Figure 6:
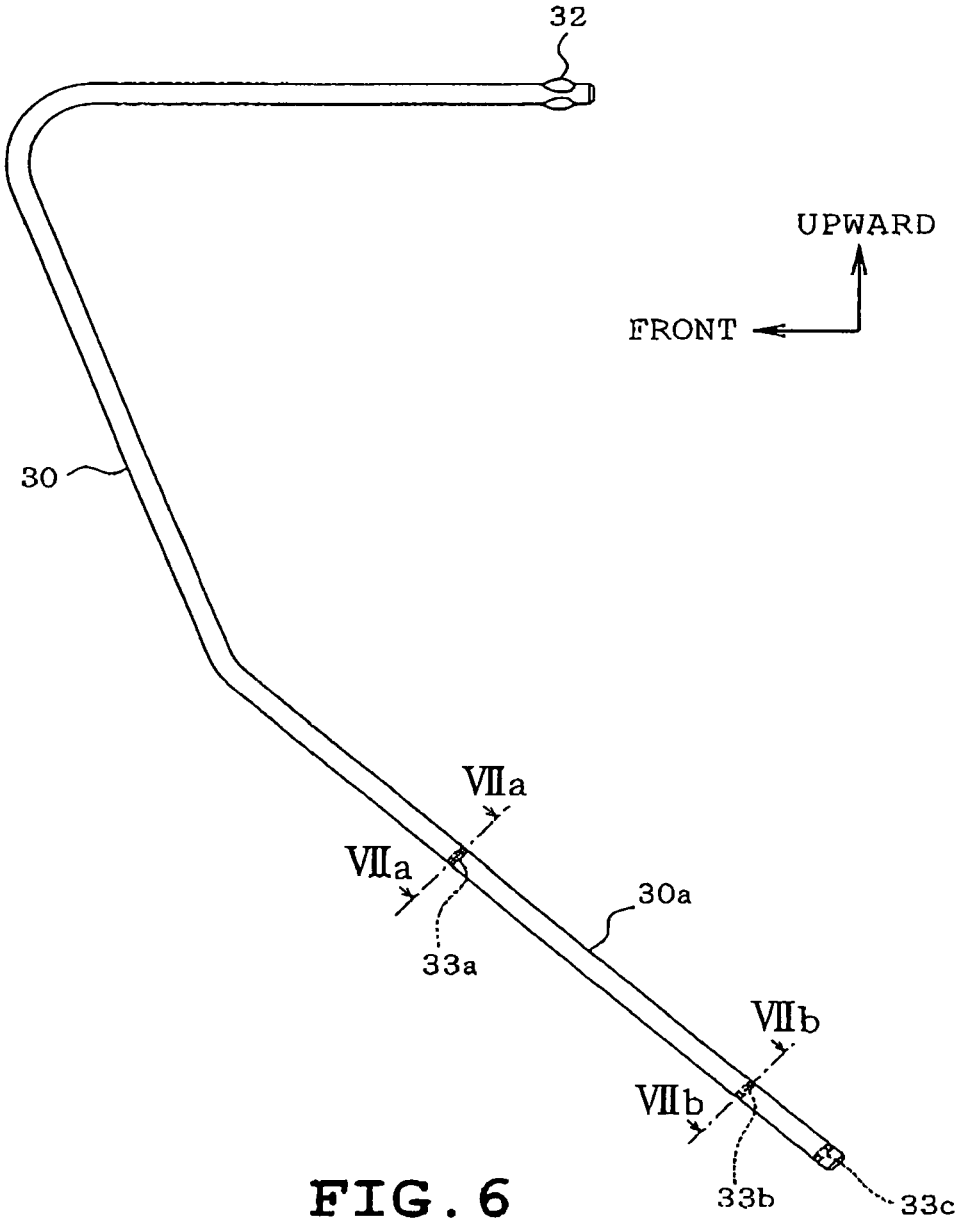
FIG. 6 is a side view of the lever in its entirety.

Referring to FIGS. 5A to 6, knee lever 20 is provided with a reverse J-shaped lever 30, and a knee rest 31 which receives the user's knee when knee lever 20 is operated.

Lever 30 comprises a metal rod, for example, and is bent to obtain the above described shape. One end, in this case, the upper end shown in FIG. 6 is integrally provided with a radially expanding engagement subject 32. Engagement subject 32 is configured to be held by the elasticity of elastic tab 23*c* when fitted into engagement retainer 23*a* of attachment 19. When engagement subject 32 is placed in fitting engagement with engagement retainer 23*a*, the lower portion of lever 30 is oriented obliquely downward as can be seen in FIG. 1. The lower portion of lever 30 serves as a support section 30*a* which supports knee rest 31 at an eccentric location of knee rest 31, in other words, at a location displaced from the center of knee rest 31. Support section 30*a* has three holes 33*a*, 33*b*, and 33*c* defined on it for example, as shown in FIG. 6.

Figure 7A:
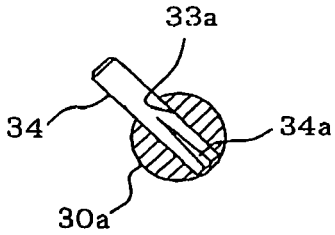
FIG. 7A is a cross sectional view taken along line VIIa-VIIa of FIG. 6.

Hole 33*a* of support section 30*a* secures engagement pin 34 inserted into it as shown in FIG. 7A. Engagement pin 34 is secured within hole 33*a* such that one end of engagement pin 34 is disposed so as to be coplanar with the outer peripheral surface of lever 30, whereas the other end projects radially outward relative to lever 30. Engagement pin 34 and support section 30*a* corresponds to a later described engagement portion 52. The above mentioned engagement pin 34 is a grooved pin having a groove 34*a* running axially on the side surface for retaining purpose.

Figure 7B:
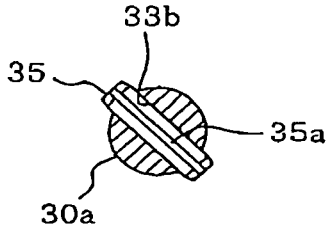
FIG. 7B is a cross sectional view taken along line VIIb-VIIb of FIG. 6.

Hole 33*b* of support section 30*a* secures auxiliary pin 35 inserted into it as shown in FIG. 7B. Auxiliary pin 35 is secured within hole 33*b* such that both ends of auxiliary pin 35 projects radially outward relative to lever 30. The above mentioned auxiliary pin 35 is a spring pin having a groove 35*a* running axially on the side surface for retaining purpose. Though not described in detail, hole 33*c* of support section 30*a* is a utility hole for inserting an assembly pin of knee rest 31.

As can be seen in FIGS. 5A and 5B, a compression coil spring 36 is wound on the lower portion of support section 30*a* and a washer 37 is disposed between auxiliary pin 35 and compression coil spring 36. As later described, compression coil spring 36 biases knee rest 31 downward, as viewed in FIGS. 5A and 5B, relative to lever 30.

Figure 8:
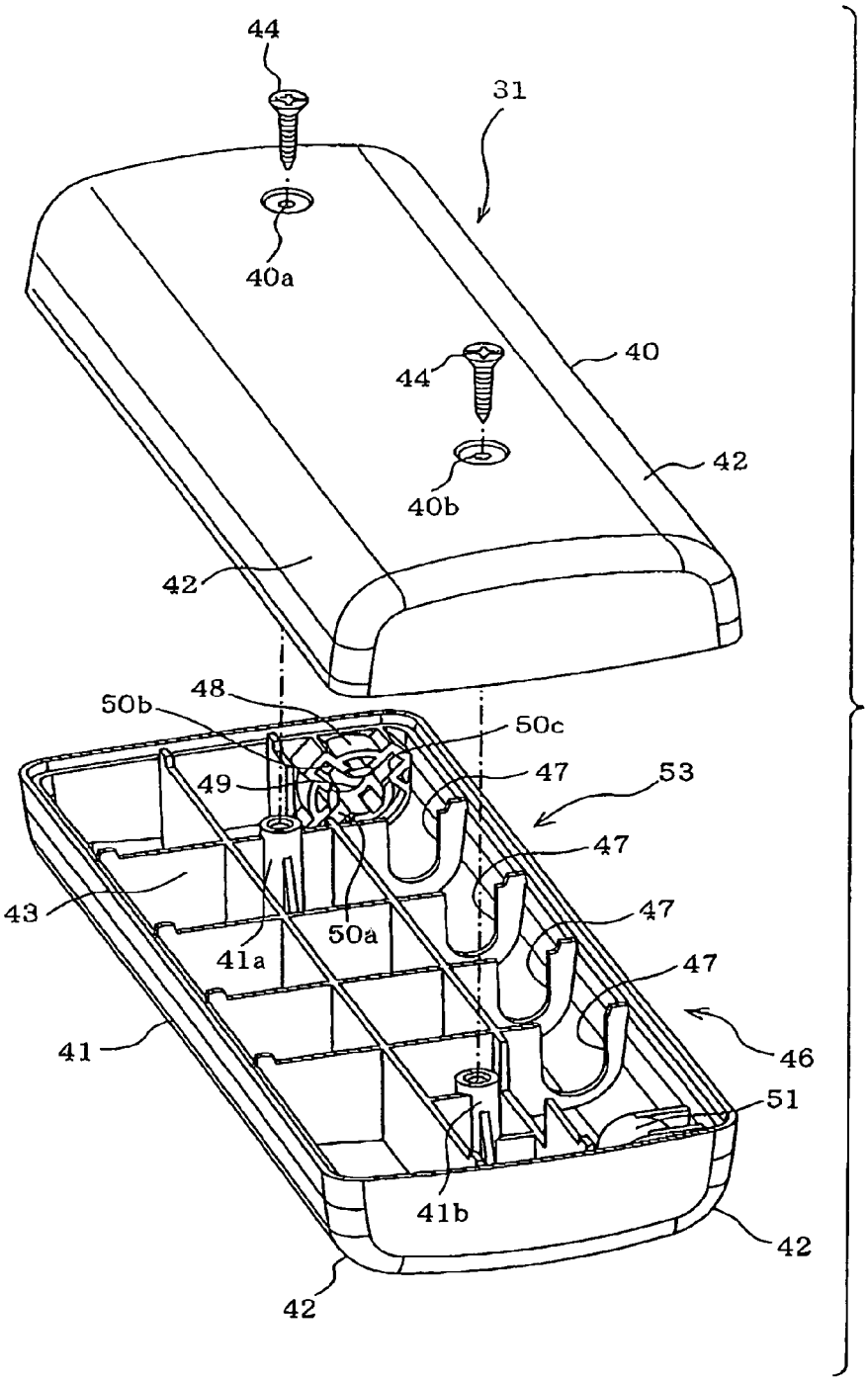
FIG. 8 is an exploded perspective view of the knee rest.
Figure 9:
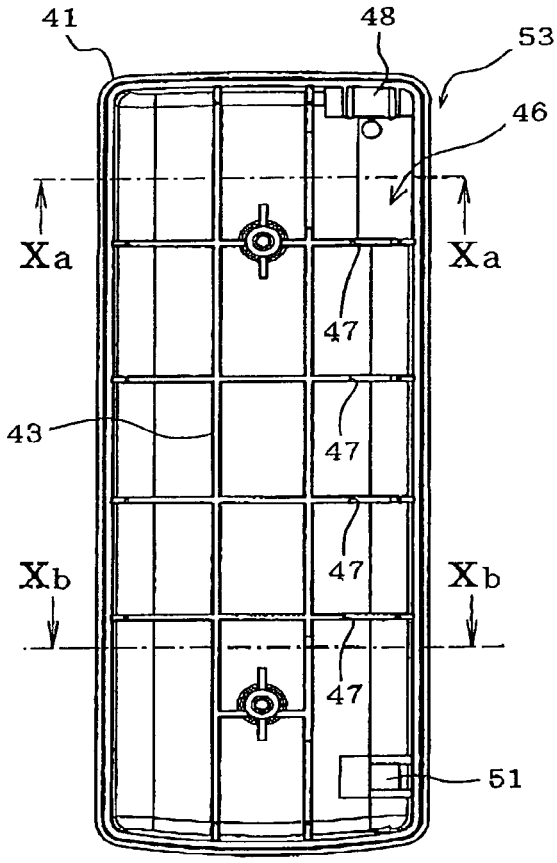
FIG. 9 is a depicts an interior structure of a second knee rest case.

Referring now to FIG. 8, knee rest 31 is split into a first knee rest case 40 and a second knee rest case 41 and when assembled, exhibit a pillar-like shape such as a square prism, with its corners chamfered to possess chamfered surfaces 42. The first and second knee rest cases 40 and 41 are both made of synthetic resin material, for instance, and are each integrally molded to have reinforcement ribs 43 in grid arrangement in their interiors. First knee rest case 40 shown on the upper side of FIG. 8 has a pair of screw holes 40*a* and 40*b* defined on it, whereas on a portion of second knee rest case 41 shown on the lower side that corresponds to screw holes 40*a* and 40*b*, bosses 41*a* and 41*b* are integrally defined to receive screws 44 screwed into screw holes 40*a* and 40*b* for assembly of the first and the second knee rest cases 40 and 41.

Near the interior edge of second knee rest case 41, a support subject 46 is defined which is supported by support section 30*a* of lever 30. A description will be given on support subject 46 with reference to FIGS. 9 to 10B.

Figure 10A:
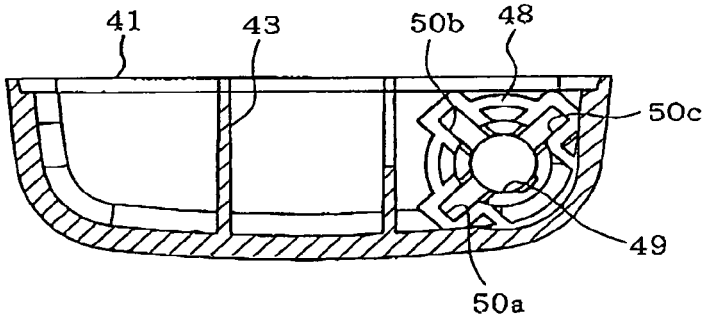
FIG. 10A is an enlarged cross sectional view taken along line Xa-Xa of FIG. 9.
Figure 10B:
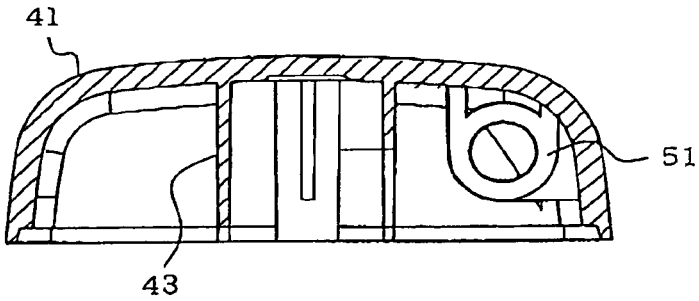
FIG. 10B is an enlarged cross sectional view taken along line Xb-Xb of FIG. 9.
Figure 11A:
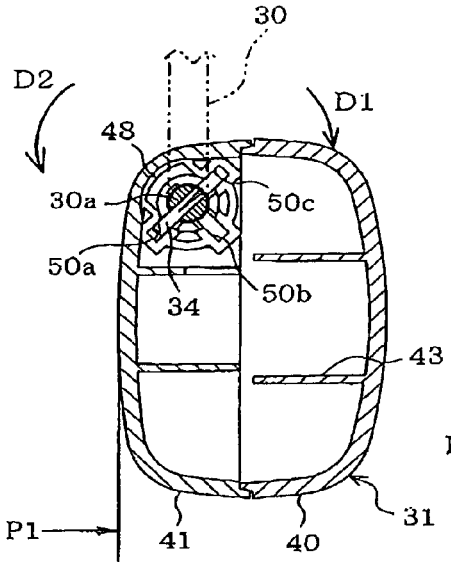
FIG. 11A, 11B, 11C and 11D are enlarged cross sectional view of a main portion of the features taken along line XI-XI of FIG. 5B and each depict the knee rest being rotated relative to the lever at 90 degree turns.
Figure 11B:
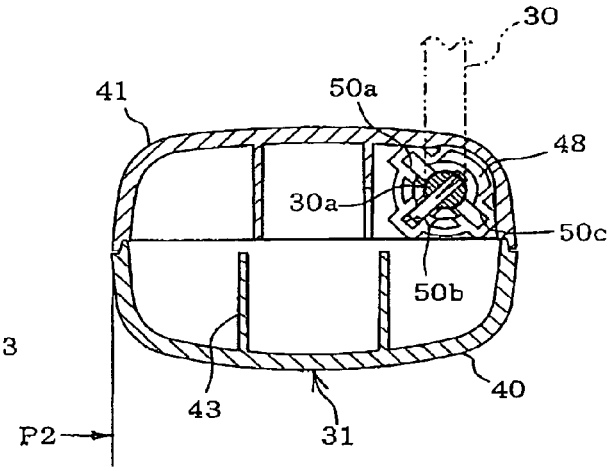
Figure 11C:
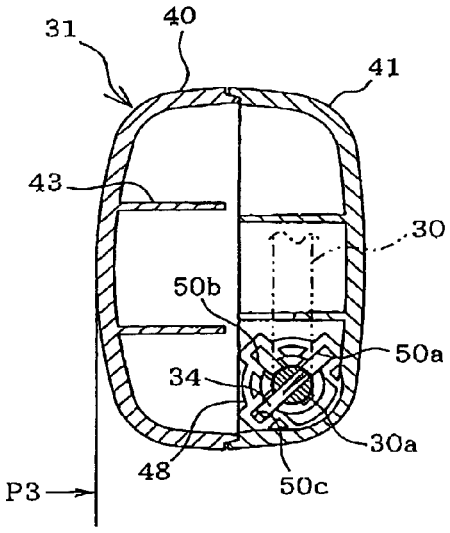
Figure 11D:
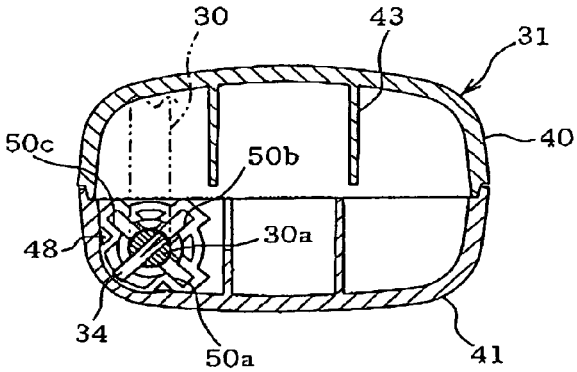

On the right side portion of reinforcement ribs 43 of second knee rest case 41, a plurality of U-shaped notches 47 is defined as can be seen in FIG. 8. Notches 47 are designed to leave slight spacing from the outer periphery of support section 30*a*. On the upper end of second knee rest 41, an upper support subject 48 is integrally formed. As can be seen in FIG. 10A, upper support subject 48 is provided with an insertion hole 49 penetrating through the upper wall of second knee rest case 41 and being placed in sliding contact with the outer periphery of support section 30*a* and a plurality of (3, for example) engagement grooves 50*a*, 50*b*, and 50*c* running radially outward from insertion hole 49. Engagement grooves 50*a* to 50*c* collectively define a T-shape and are each recessed upward to allow insertion of engagement pin 34 from below. That is, engagement grooves 50*a* and 50*b* and engagement grooves 50*b* and 50*c* define an angular interval of 90 degrees respectively between them. The angular intervals between engagement grooves 50*a*, 50*b*, and 50*c* and the number of engagement grooves provided may be varied as found appropriate.

Second knee rest case 41 is further provided integrally with a cylindrical lower support subject 51 which is slightly elevated from the bottom of second knee rest case 41. The inner periphery of lower support subject 51 is placed in sliding contact with the outer periphery of support section 30*a* and is biased downward at its upper end by compression coil spring 36. The bias of compression coil spring 36 forces engagement pin 34 to be in constant engagement with either of engagement grooves 50*a* to 50*c* so that knee rest 31 is locked in a stationary state shown in FIG. 5A in which relative rotation about lever 30 is prohibited. However, when knee rest 31 is lifted against the bias of compression coil spring 36 by user operation in the direction indicated by the arrow in FIG. 5B, engagement pin 34 is disengaged from engagement grooves 50*a* to 50*c* to allow relative rotation of knee rest 31 to lever 30 as shown in the state described in FIG. 5B. Notches 47, upper support section 48 and lower support section 51 constitute support subject 46 which is supported vertically movably and rotatably by support section 30*a* of lever 30. When the above described engagement pin 34 is disengaged, knee rest 31 is allowed to revolve 360 degrees about lever 30 in both in arrow D1 direction (clockwise) and arrow D2 direction (counterclockwise) shown in FIG. 11A.

By locating engagement pin 34 with either of engagement grooves 50*a* to 50*c* during rotation of knee rest 31, the mounting position of knee rest 31 is switched. More specifically, the mounting position is switched between a first position shown in FIG. 11A in which engagement pin 34 is engaged with engagement groove 50*a*, a second position shown in FIG. 11B in which engagement pin 34 is engaged with engagement groove 50*b*, and a third position shown in FIG. 11C in which engagement pin 34 is engaged with engagement groove 50*c*. Support subject 46 and engagement grooves 50*a* to 50*c* constitute engagement subject 53 that is disengagably engaged with engagement portion 52 to switch the mounting position of knee rest 31 relative to lever 30. Engagement subject 53 and engagement portion 52 constitute an adjustment mechanism 54 of the present disclosure.

Next, a control system of sewing machine M according to the present disclosure will be described with reference to a block diagram given in FIG. 12. Controller 55 responsible for controlling sewing machine M is configured primarily by a microcomputer including components such as a CPU 55*a*, a ROM 55*b*, and a RAM 55*c*.

Controller 55 establishes connections with components such as start/stop switch 9, presser foot vertically moving switch 10, and potentiomotor 26, as well as a drive circuit 56 for sewing machine motor 5, and a drive circuit 57 for presser foot drive motor 15.

Controller 55 performs operations such as calculation for obtaining the position of knee lever 20 (in the present disclosure, determining whether or not knee lever 20 is in the operative position) based on the resistance sensed by potentiometer 26. ROM 55*b* stores a sew control program etc., while memory such as buffers and counters required for execution of various controls are allocated to RAM 55*c* as required. Controller 55 executes sewing operations on a workpiece cloth by driving actuators such as sewing machine motor 5 and presser foot drive motor 15 according to the sew control program.

Next, a description will be given on the operation of the above described configuration. Referring to FIG. 1, when knee lever 20, being attached to attachment 19 of rotary element, is in a standby position, presser foot 6 is biased downward by spring 14 along with presser bar 7 through presser bar clamp 13. At this instance, knee rest 31 is switched to the first position indicated by a solid line in FIG. 1 where it is adjusted to contact the right knee of the user schematically illustrated as a right knee RH at contact position P1. The left knee of the user is similarly schematically illustrated as a left knee LH.

Under this state, rightward movement of right knee RH placed in contact with knee rest 31 displaces knee lever 20 toward the operative position from the standby position. Responsively, rotary element 22 of attachment 19 rotates counterclockwise as viewed in FIG. 4B, against the bias of torsion coil spring 25*a* and helical extension spring 25*b* to lift arm 26*a* of rotary shaft of potentiometer 26. At this instance, controller 55 determines whether or not knee lever 20 is in the operative position based on the detection signal produced by potentiometer 26. When determining that knee lever 20 is in the operative position as shown in FIG. 2, presser foot drive motor 15 is driven to move presser foot 6 to the elevated position through drive gear 15*a*, intermediate gear 16 and rack forming element 11.

After moving knee lever 20 to the operative position by the pressure exerted by the user's knee placed in contact with knee lever 20, if the user cancels the pressure contact, in other words, returns right knee RH to its original position, knee lever 20 returns to the standby position by the bias etc., of torsion spring 25*a* and helical extension spring 25*b*. Thus, controller 55 drives presser foot drive motor 15 based on detection signal produced by potentiometer 26 to lower presser foot 6 to the pressed position.

If the user feels that knee rest 31 is too far away in the light of user's preference or physique, knee rest 31 may be moved closer to right knee RH by adjustment mechanism 54 to consequently move the contact position closer toward the user. More specifically, when the user lifts knee rest 31 in the direction indicated by the arrow shown in FIG. 5B against the bias of compression coil spring 36, engagement pin 34 is disengaged from engagement groove 50*a*. Under such state, when knee rest 31 is rotated about lever 30 in arrow D1 direction or arrow D2 direction to locate engagement pin 34 with engagement groove 50*b*, the mounting position of knee lever 31 is switched from the first position to the second position. Thus, knee rest is adjusted to contact right knee RH of the user at contact position P2 as shown in FIG. 1.

If the user feels that the first position is too far and the second position is too close, the user may switch knee rest 31 to the third position by going through the same operation.

More specifically, knee rest 31 is lifted relative to lever 30 by the user to disengage engagement pint 34 from engagement groove 50*b* and thereafter rotated about lever 30 to locate engagement pin 34 with engagement groove 50*c*. Thus, knee rest 31 is adjusted to contact right knee RH of the user at contact position P3. The above described adjustment may be made with knee lever 20 attached to attachment 19 but can be done much easier by removing knee lever 20 from attachment 19.

Though not described in detail, presser foot 6 may be vertically moved through operation of a presser foot lifting lever 17 or presser foot lifting vertically moving switch 10 without using knee lever 20.

As described above, knee lever 20 according to the present exemplary embodiment is configured to allow adjustment in contact position of knee rest 31 relative to right knee RH from the selection of contact positions P1 to P3. Thus, knee lever 20 need not be repositioned in its entirety through troublesome fastening/unfastening of coupling elements such as screws when the user feels that knee lever 20 is too far or too close. This allows the user to readily adjust knee lever 20 to the desired operational position suitable for the users' physique and preference without any troublesome use of tools, thereby improving operability of knee lever 20. Further, because adjustment mechanism 54 is provided at knee lever 20 and not at the sewing machine, the sewing machine does not require any adjustment features in addition to its conventional configuration. Thus, knee lever 20 may be used in different types of sewing machines that is designed for detachable attachment of a knee lever and allow adjustments in the contact position of knee lever from the selection of contact positions P1 to P3.

Adjustment mechanism 54 comprises engagement portion 52 provided at lever 30 and engagement subject portion 53 provided at knee rest 31 which disengagably engages with engagement portion 52 to allow switching in the mounting position of knee rest 31 relative to lever 30. This allows the mounting position of knee rest 31 to be switched by merely engaging/disengaging engagement subject 53 to/from engagement portion 52 to simplify the configuration of adjustment mechanism 54.

Engagement portion 52 comprises support section 30*a* and engagement pin 34. Engagement subject 53, on the other hand, comprises a plurality of engagement grooves 50*a* to 50*c* being disposed around support section and selectively engaging with engagement pin 34, and support subject 46 being supported by support section 30*a* so as to be switchable between the engagement positions determined by the selective engagement of engagement pin 34 with engagement grooves 50*a* to 50*c*. The above arrangement minimizes the number of parts required at adjustment mechanism 54 to simplify its configuration as much as possible while allowing a compact installation of adjustment mechanism 54 within knee rest 31. Further, usability is improved by allowing the mounting position of knee rest 31 to be switched to the desired position (the first to third position) by mere switching of the engagement positions as described earlier.

FIGS. 13A to 16 describe a second exemplary embodiment of the present disclosure. Elements that are identical to the first exemplary embodiment are represented by identical reference symbols and a description will be given only on elements that differ from the first exemplary embodiment.

Knee lever 60 of the second exemplary embodiment differs from knee lever 20 of the first exemplary embodiment in the following respects. Knee rest 61 of knee lever 60 is made of synthetic resin material, for example, and is provided integrally with a rectangular knee rest body 61*a* extending in the front-rear direction, and an upper mount 61*b* and lower mount 61*c* provided at the upper portion and lower portion of knee rest body 61*a* respectively. Among the two opposing surfaces in the width direction of knee rest body 61*a*, the surface facing right knee RH, the left side as viewed in FIG. 13A defines an operative surface 61*d*.

An adjustment mechanism 62 of the present exemplary embodiment is provided with a link mechanism 63 that joins the knee rest 61 and lever 30, and a retention mechanism that retains the distance between knee rest 61 and lever 30 at a predetermined distance.

Link mechanism 63 is provided with a pair of parallel links namely a first link 65 and a second link 66 that interpose knee rest 61 and lever 30. To elaborate, upper mount 61*b* and lower mount 61*c* of knee rest 61 is provided with hinge pins 67*a* and 67*b*, for example, whereas on the lower portion of lever 30, hinge pins 68*a* and 68*b*, for example, are provided at locations corresponding to hinge pins 67*a* and 67*b* of knee rest 61. Both first and second links 65 and 66 have a reversed C-shaped cross section that extend in a linear fashion and have identical lengths. One end (right end) of first link 65 is rotatably linked on lever 30 by hinge pin 68*a* and the other end (left end) is linked rotatably to knee rest 61 by hinge pin 67*a*. The right end of second link pin 66 is linked rotatably to lever 30 by hinge pin 68*b* and the left and is linked rotatably to knee rest 61 by hinge pin 67*b*. First link 65, second link 66, hinge pins 67*a*, 67*b*, 68*a*, and 68*b* constitute link mechanism 63 that links knee rest 61 and lever 30 with adjustment capabilities in the distance between the linked knee lever 61 and lever 30. Link mechanism 63 is configured as a parallel four segment link mechanism that moves knee rest 61 toward lever 30 substantially parallel.

Retention mechanism 64 is disposed at link mechanism 63 and is provided with a positioning plate 71, a repositioning button 72 configured to longitudinally reciprocate between a protruding position and a depressed position relative to positioning plate 71, and a compression coil spring 73 that biases positioning button toward the protruding position.

Figure 14:
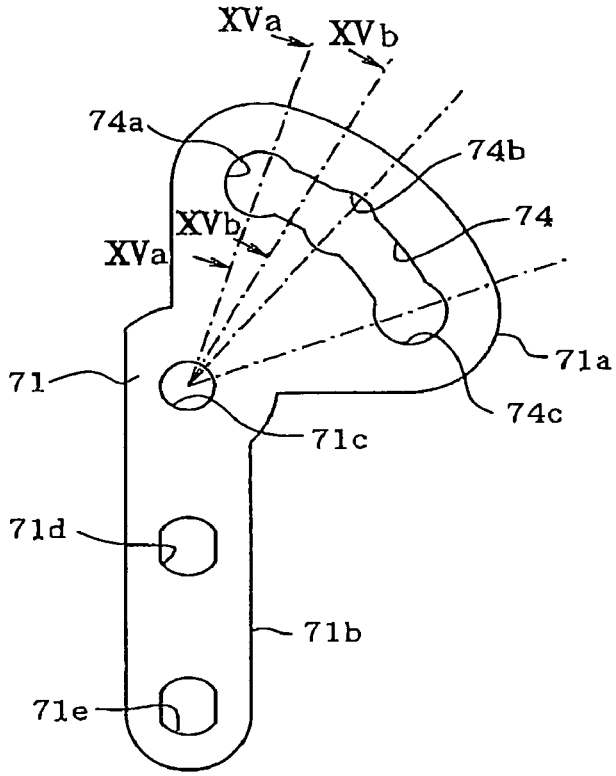
FIG. 14 is an enlarged view of a positioning plate.

As shown in FIG. 14, positioning plate 71 is made of metal, for example, and is integrally provided with a head 71*a* having a guide groove 74 defined on it and a fastening portion 71*b* extending longitudinally to exhibit, in its entirety, a shape resembling a bottle cap opener. On the upper portion of fastening portion 71*b*, a through hole 71*c* is provided through which hinge pin 67*a* of knee rest 61 penetrates, and a couple of upper mount hole 71*d* and a lower mount hole 71*e* are provided on the lower portion of fastening portion 71*b*. Guide groove 74 of head 71*a* runs along the circumference centering on through hole 71*c* and guides a later described small diameter portion 72*a* of repositioning button 72 shown in FIG. 15B. Head 71*a* has fitting holes 74, 74*b*, and 74*c* defined on it along guide groove 74 in the listed sequence from the top of guide groove 74. Fitting holes 74*a*, 74*b*, and 74*c* allow the fitting engagement of a later described large diameter portion 72*b* of repositioning button 72 as shown in FIG. 15A.

Figure 13A:
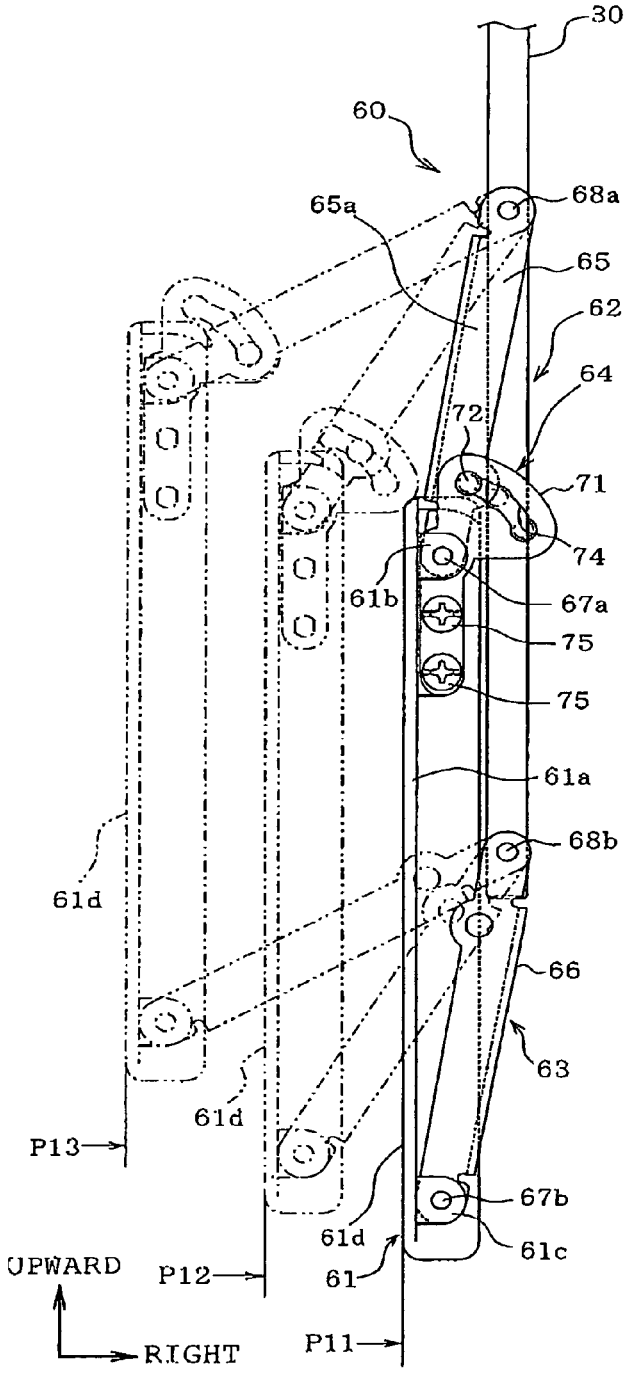
FIG. 13A is an enlarged front view of the proximity of the knee rest according to a second exemplary embodiment of the present disclosure.
Figure 13B:
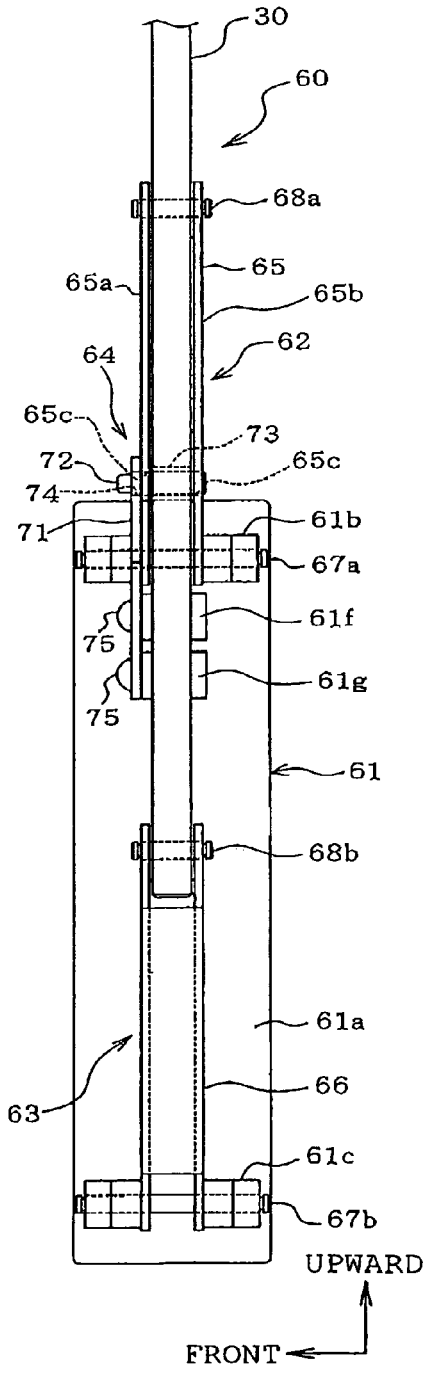
FIG. 13B is an enlarged side view of the proximity of the knee rest according to a second exemplary embodiment of the present disclosure.

Knee rest 61, on the other hand, has a couple of bosses 61*f* and 61*g* disposed immediately under upper mount 61*b* as shown in FIG. 13B. Positioning plate 71 is fastened on knee rest 61 through screw engagement of screws 75 inserted though mount holes 71*d* and 71*e* with bosses 61*f* and 61*g* of knee rest 61.

Figure 15A:
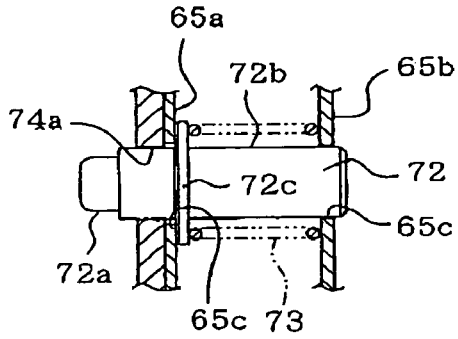
FIG. 15A is an enlarged cross sectional view of a repositioning button taken along line XVa-XVa of FIG. 14.

As can be seen in FIGS. 13B and 15A, on a front wall 65*a* and rear wall 65*b* of first link 65, an insertion hole 65*c* is defined that runs vertically in communication with guide groove 74 of positioning plate 71. Repositioning button 72 is inserted through the insertion holes 65*c*. Repositioning button 72 comprises a large diameter portion 72*b* being cylindrical in form, a small diameter portion 72*a* provided at the front end (relatively closer to positioning plate 71) of large diameter portion 72*b*, and a stop ring 72*c* attached on a relatively forward portion of large diameter portion 72*b*.

Compression coil spring 73 is situated between stop ring 72*c* and rear wall 65*b* of first link 65 to forwardly bias repositioning button 72. Repositioning button 72 is thus, moved forward to the protruding position (refer to 15A) in which stop ring 72*c* is locked in against front wall 65*a* of first link 65 and large diameter portion 72 of repositioning button 72 is fitted into one of fitting holes 74*a* to 74*c* from the rear side. This fitting engagement unmovably locks positioning plate 71 against first link 65 to prohibit movement of link mechanism 63.

Figure 15B:
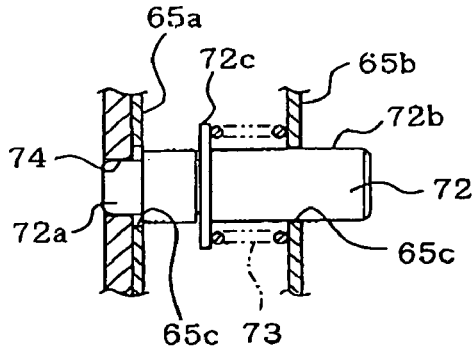
FIG. 15B is an enlarged cross sectional view of a repositioning button taken along line XVb-XVb of FIG. 14.

On the other hand, when small diameter portion 72*a* of repositioning button 72 is pressed against the bias of compression coil spring 73, repositioning button 72 is moved to the depressed position shown in FIG. 15B being coplanar with positioning plate 71. Under this state, relative movement of repositioning button 72 along guide groove 74 is permitted, and thus, knee rest 61 can be moved closer to the user to be moved away from lever 30 as required. Then by locating repositioning button 72 with either of fitting holes 74*a* to 74*c* and canceling the depression of repositioning button 72, the position of the knee rest is switched. To elaborate, the position of knee rest 61 is switched between the first position shown in solid line in FIG. 13A in which large diameter portion 72*a* is fitted into fitting hole 74*a*, the second position shown in double-dot chain line in FIG. 13A in which large diameter portion 72*a* is fitted into fitting hole 74*b*, and the third position shown in double-dot chain line in FIG. 13A in which large diameter portion 72*c* is fitted into fitting hole 74*c*.

Next, a description will be given on the operation of the above described configuration.

When knee lever 60 is in a standby position, with lever 30 being attached to attachment 19 of rotary element, presser foot 6 is lowered to the press position. At this instance, knee rest 61 is switched to the first position indicated by a solid line in FIG. 13A where it is adjusted to contact right knee RH at contact position P11. If relocation button 72 is not depressed, the fitting engagement of large diameter portion 72*b* of repositioning button 72 with fitting engagement hole 74*a* retains the positioning of knee rest 61 and lever 30 with relatively small distance therebetween.

Figure 16:
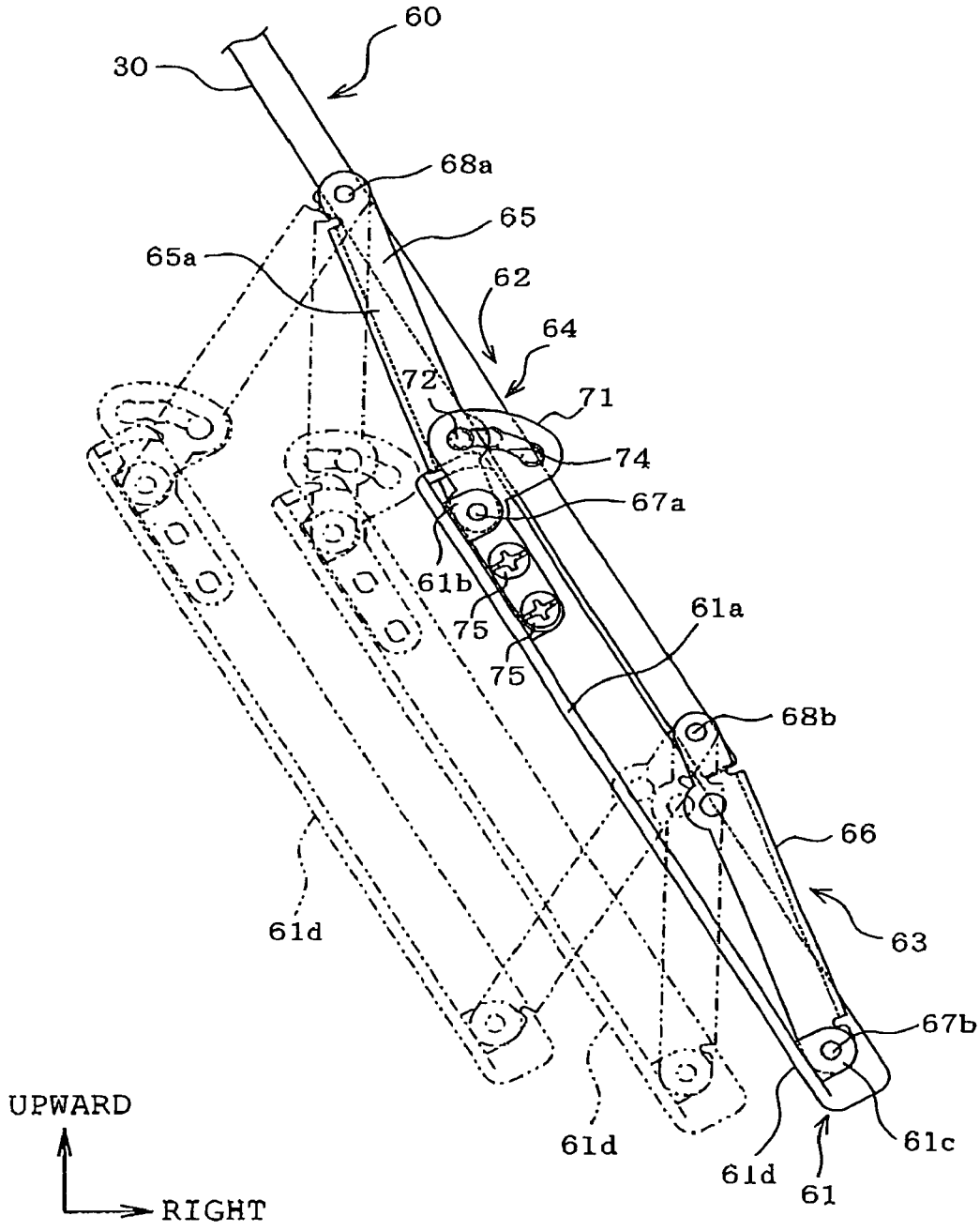
FIG. 16 corresponds to FIG. 13A with the knee lever being moved to the operative position.

Under this state, rightward movement of right knee RH placed in abutment with knee rest 61 displaces knee lever 20 toward the operative position from the standby position as shown in FIG. 16. Responsively, rotary element 22 of attachment 19 rotates to lift arm 26*a* of rotary shaft of potentiometer 26, consequently driving presser foot drive motor 15 to move presser foot 6 to the elevated position.

If the user feels that knee rest 61 is too far away, knee rest 61 and consequently the contact position may be moved closer to right knee RH through following adjustments. Repositioning button 72 is depressed to the depressed position against the bias of compression coil spring 73 and knee rest 61 is moved away from lever 30 with the depressed state of repositioning button 72 maintained. At this instance, small diameter portion 72*a* of repositioning button 72 is relatively moved along guide groove 74 toward fitting hole 74*b* from fitting hole 74*a*. After locating repositioning button 72 with fitting hole 74*b* and canceling the depression, the position of the knee rest 61 is switched from the first position to the second position. Thus, knee rest 61 is adjusted to contact right knee RH of the user at contact position P12 as shown in FIG. 13A.

The user may further depress repositioning button 72 again to further increase the distance between knee rest 61 and lever 30. After locating repositioning button 72 with fitting hole 74*c* and canceling the depression, the position of the knee rest 61 is switched from the second position to the third position. Thus, knee rest 61 is adjusted to contact right knee RH of the user at contact position P13 as shown in FIG. 13A. When switching the position of knee rest 61, knee rest 61 is moved substantially parallel to lever 30 by link mechanism 63 to place operative surface 61d contacting right knee RH in a substantially vertical state at contact positions P11 to P13.

According to the above described configuration, adjustment mechanism 62 is provided with a link mechanism 63 that links lever 30 and knee rest 61 and that allows adjustment (modification) in the distance between lever 30 and knee rest 61. Thus, by using link mechanism 63, knee rest 61 can be moved accurately to the desired contact positions P11 to P13 with a relatively simple configuration. Link mechanism 63 employs a parallel four segment configuration to allow operative surface 61*d* of knee lever 61 to exhibit a substantially vertical state at each of contact positions P11 to P13. Such arrangement allows the user to operate the operative surface 61*d* stresslessly to provide favorable operability. Adjustment mechanism 62 is further provided with retention mechanism 64 that retains a predetermined distance between lever 30 and knee rest 61. Thus, the mounting position of knee rest 61 once specified can be prevented from being precariously switched to other mounting positions.

Figures 17A, 17B:
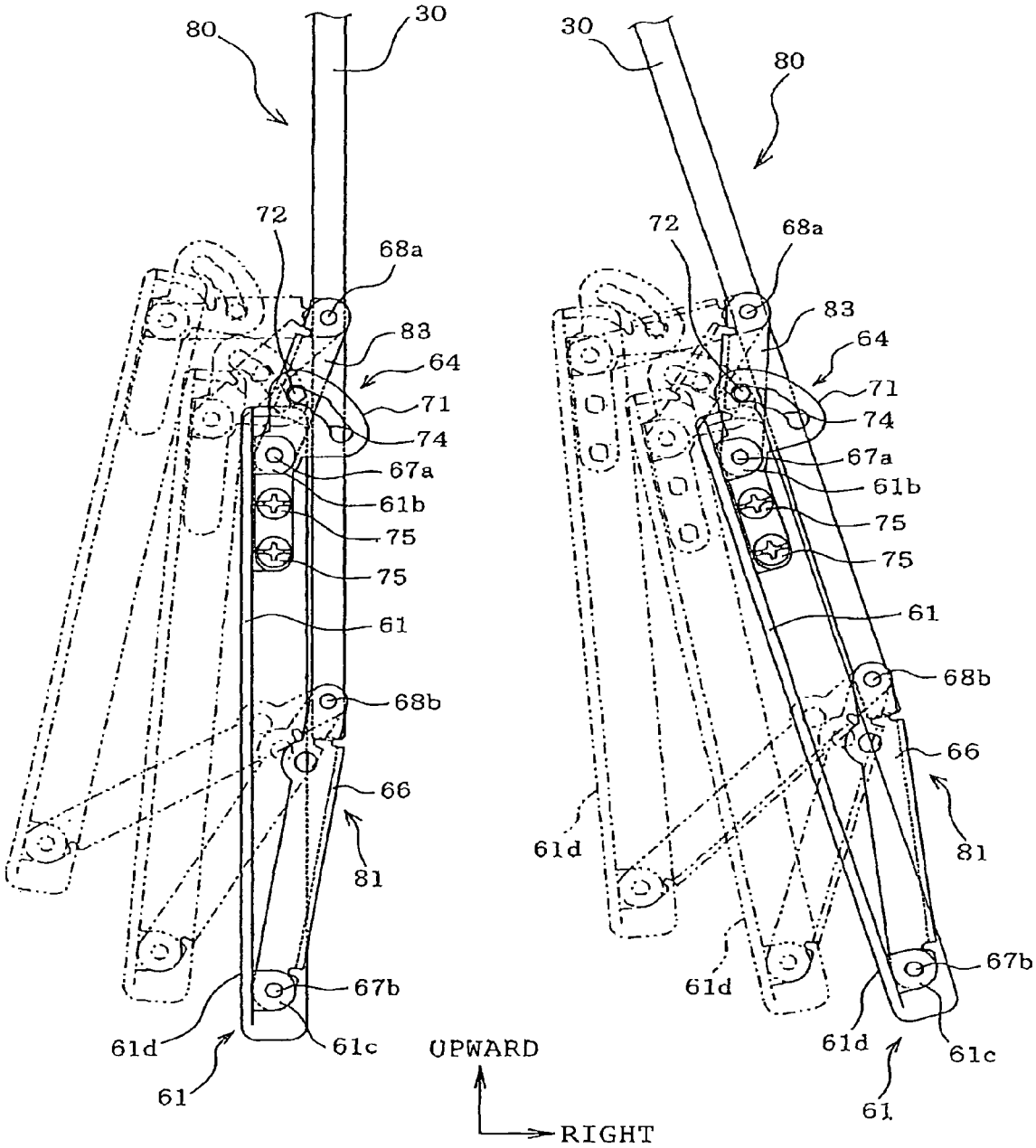
FIG. 17A corresponds to FIG. 13A and depicts a third exemplary embodiment of the present disclosure.
FIG. 17B corresponds to FIG. 16.

FIGS. 17A and 17B show a third exemplary embodiment of the present disclosure. Elements that are identical to the second exemplary embodiment are identified with identical reference symbols and a description will be given only on elements that differ.

Knee lever 80 of the third exemplary embodiment differs from knee lever 60 of the second exemplary embodiment in the following respects. Knee lever 80 is provided with a link mechanism 81 having a first link 83 which is reduced in length compared to first link 65 of the second exemplary embodiment. Link mechanism 81 is a non-parallel four segment link mechanism in which the length of first link 83 and second link 66 differ to allow the position of knee rest 61 to be switched such that operative surface 61*d* of knee lever 80 in operative position presents a nearly vertical inclination.

To elaborate, the position of knee rest 61 is switched, in listed sequence from right side as viewed in FIG. 17A, between: the first position shown in FIG. 17A in which large diameter portion 72*a* of repositioning button 72 is fitted into fitting hole 74*a*, the second position in which large diameter portion 72*b* is fitted into fitting hole 74*b*, and the third position shown in FIG. 13A in which large diameter portion 72*c* is fitted into fitting hole 74*c*. As can be seen in FIG. 17B, knee rest 61, in the operative position, gradually switches its inclination to proximate the vertical orientation as it proceeds to the second and the third position.

As described above, link mechanism 81 of the third exemplary embodiment is configured to place operative surface 61d in a substantially vertical incline at the operative position of knee lever 60 by switching the position of knee rest 61 to the third position. On the other hand, by switching the position of knee rest 61 to the first position in the standby position, knee rest 61 can be approximated to lever 30 in alignment with lever 30, and place operative surface 61*d* to present a substantially vertical incline. The above described configuration allows operative surface 61*d* of knee rest 61 to be adjusted in the desired angle according to user preference to improve the usability of knee lever 60.

The present disclosure is not limited to the exemplary embodiments described above or shown in the accompanying drawings but may be modified or expanded as follows. The present disclosure may be applied to sewing machines in general that are provided with presser bar 7 having presser foot 6 at its lower end and not limited to a general household sewing machine M.

In the first exemplary embodiment, the shape of knee rest 31 is not limited to a square prism but may come in any form as long as it is a three dimensional element provided with an operative surface that is operated through contact to the user's knees and that is supported by support section 30*a* at a position displaced from the center of the three dimensional element such as a cylindrical column, a triangular prism, and a pentagonal prism. Under such modified configuration also, adjustment can be made on the contact position of the operative surface relative to the user's knee by rotating the three dimensional element about support section 30*a*.

In the second and third exemplary embodiment, repositioning button 72 serves as the engagement portion and fitting holes 74*a* to 74*c* serve as the engagement subject portion. Engagement portion and engagement subject may come in any form as long as they are provided between the lever and the knee rest and allow switching in the mounting position of the knee rest relative the lever through disengagable engagement of the engagement subject to the engagement portion.

The parallel and non-parallel four segment link mechanism provided in the second and third exemplary embodiments may be replaced by other link mechanism with different number of segments.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A knee lever for use in a sewing machine including a bed having an attachment, a head, and a presser bar being supported by the head and having a presser foot at a lower end thereof, the knee lever being detachably attached to the attachment and being operated by knee contact to lift the presser foot, the knee lever comprising:

a lever that is detachably attached to the attachment;

a knee rest that is mounted on the lever and that is operated by knee contact, with the lever being attached to the attachment;

an adjustment mechanism that allows adjustment in position of knee contact of the knee rest;

wherein the adjustment mechanism includes an engagement portion that is provided at the lever, and an engagement subject that is provided at the knee rest and being disengagably engaged with the engagement portion to switch a mounting position of the knee rest relative to the lever, wherein the engagement portion includes a support section that supports the knee rest, and an engagement pin provided at the support section, wherein the engagement subject includes a plurality of engagement grooves that are situated around the support section and that is placed in selective engagement with the engagement pin, and a support subject that is switchably supported by the support section at different engagement positions of the engagement pin with the engagement grooves, and wherein the mounting position of the knee rest is switched through the selective engagement of the engagement pin at different engagement positions.

2. The knee lever according to claim 1, further comprising a biasing element that exerts bias toward a direction to retain engagement between the engagement pin and the engagement grooves.

3. A sewing machine comprising:

a bed having an attachment;

a head;

a presser bar being supported by the head and having a presser foot at a lower end thereof;

a knee lever that is detachably attached to the attachment and being operated by knee contact to lift the presser foot, the knee lever including:

a lever that is detachably attached to the attachment;

a knee rest that is mounted on the lever and that is operated by knee contact, with the lever attached to the attachment;

an adjustment mechanism that allows adjustment in position of knee contact of the knee rest;

wherein the adjustment mechanism includes an engagement portion that is provided at the lever, and an engagement subject that is provided at the knee rest and being disengagably engaged with the engagement portion to switch a mounting position of the knee rest relative to the lever, wherein the engagement portion includes a support section that supports the knee rest, and an engagement pin provided at the support section, wherein the engagement subject includes a plurality of engagement grooves that are situated around the support section and that is placed in selective engagement with the engagement pin, and a support subject that is switchably supported by the support section at different engagement positions of the engagement pin with the engagement grooves, and wherein the mounting position of the knee rest is switched through the selective engagement of the engagement pin at different engagement positions.

4. The knee lever according to claim 3, further comprising a biasing element that exerts bias toward a direction to retain engagement between the engagement pin and the engagement grooves.

* * * * *